US008845833B2

(12) United States Patent
Zebregs et al.

(10) Patent No.: US 8,845,833 B2
(45) Date of Patent: Sep. 30, 2014

(54) METHOD FOR PREPARING A PYROTECHNIC COMPOSITION AND CHARGE

(75) Inventors: Martijn Zebregs, Rijswijk (NL); Murk Pieter van Rooijen, Stellendam (NL); Rutger Webb, Rotterdam (NL)

(73) Assignee: Clearspark, LLC, Glendale, CA (US)

( * ) Notice: Subject to any disclaimer, the term of this patent is extended or adjusted under 35 U.S.C. 154(b) by 0 days.

(21) Appl. No.: 13/522,738

(22) PCT Filed: Jan. 19, 2011

(86) PCT No.: PCT/NL2011/050030

§ 371 (c)(1), (2), (4) Date: Sep. 19, 2012

(87) PCT Pub. No.: WO2011/090375

PCT Pub. Date: Jul. 28, 2011

(65) Prior Publication Data

US 2013/0025748 A1 Jan. 31, 2013

(30) Foreign Application Priority Data

Jan. 19, 2010 (EP) ..... 10151038

(51) Int. Cl.

*C06B 25/20* (2006.01)
*C06B 45/10* (2006.01)
*C06C 15/00* (2006.01)

(52) U.S. Cl.

CPC ..... *C06B 25/20* (2013.01); *C06C 15/00* (2013.01); *C06B 45/10* (2013.01)
USPC ..... 149/109.6; 149/19.92

(58) Field of Classification Search

CPC ..... C06B 21/00; C06B 21/0016; C06C 15/00
See application file for complete search history.

(56) References Cited

U.S. PATENT DOCUMENTS

| | | | | |
|---|---|---|---|---|
| 3,545,333 | A * | 12/1970 | Van Langenhoven | 86/1.1 |
| 3,854,400 | A * | 12/1974 | Van Langenhoven | 102/431 |
| 6,170,399 | B1 | 1/2001 | Nielson et al. | |
| 6,214,139 | B1 | 4/2001 | Hiskey et al. | |

FOREIGN PATENT DOCUMENTS

| | | | |
|---|---|---|---|
| CN | 101077846 | A | 9/2011 |
| DE | 9416112 | U1 | 12/1994 |
| EP | 1205459 | | 5/2002 |
| EP | 1932817 | | 6/2008 |
| EP | 1982968 | | 10/2008 |
| EP | 1982969 | | 10/2008 |
| WO | WO02/84458 | | 10/2002 |
| WO | WO2011090375 | | 7/2011 |

OTHER PUBLICATIONS

Database (CA) [Online] Chemical Abstracts Service, Columbus, Ohio, US; Wei, Deixan et al: "Nitrocellulose—based gas-generating agent for pretensioning of vehicle safety belts", XP002603598, retrieved from STN Database accession No. 148:81631 abstract.
International Search Report from PCT/NL2011/050030 mailed Jun. 5, 2011.

* cited by examiner

*Primary Examiner* — Aileen B Felton
(74) *Attorney, Agent, or Firm* — Marsh Fischmann & Breyfogle LLP; Kent A. Lembke

(57) ABSTRACT

The invention is directed to a method for preparing a pyrotechnic composition, to the use of a water-soluble cellulose ether binder, to a pyrotechnic composition, to a method for preparing a pyrotechnic charge, and to a pyrotechnic charge. The method of the invention comprises mixing the fibrous nitrocellulose in wet form with the one or more water-soluble cellulose ether binders and optionally one or more solvents, wherein the amount of organic solvent in the mixture is 10 wt. % or less based on total weight of the mixture.

21 Claims, No Drawings

METHOD FOR PREPARING A PYROTECHNIC COMPOSITION AND CHARGE

CROSS-REFERENCE TO RELATED APPLICATIONS

This application is a national phase of PCT Application No. PCT/NL2011/050030 filed on Jan. 19, 2011, entitled "METHOD FOR PREPARING A PYROTECHNIC COMPOSITION AND CHARGE," which claims priority from EP Application No. 10151038.6, filed on Jan. 19, 2010, both of which are hereby incorporated by reference into this application in their entirety.

The invention is directed to a method for preparing a pyrotechnic composition, to the use of a water-soluble cellulose ether binder, to a pyrotechnic composition, to a method for preparing a pyrotechnic charge, and to a pyrotechnic charge.

Pyrotechnics (the art of fire) is the science of materials capable of undergoing self-contained and self-sustained exothermic chemical reactions for the production of heat, light, gas, smoke, and/or sound. Pyrotechnics include not only the manufacture of fireworks, but items such as safety matches, oxygen candles, explosive bolts and fasteners, and components of the automotive airbag.

Materials used in pyrotechnic compositions can in general be classified as follows: oxidising agents, agents having a dual-role of oxidising agent and colourant, colourants, pyrotechnic fuels, smoke dyes, binders, and other chemical additives.

With respect to the binders, a variety of materials have been used in the art for the manufacture of pyrotechnic compositions. Depending upon the type of system/composition, the requirements of the binder may vary. Conventional materials used as binders for pyrotechnic compositions include natural products such as dextrins, gums, resins, and occasionally also synthetic polymers. Also cellulose-based binder materials have been proposed such as hydroxyethyl cellulose (GB-A-1 445 564).

Pyrotechnic compositions can be employed in a variety of applications, such as in fireworks, gas generators and inflators, military flares, and distress signals. Unfortunately, the burning of large quantities of such pyrotechnic compositions can generate large amounts of smoke, which for a number of reasons is undesirable. Accordingly, attempts have been made to propose pyrotechnic compositions that produce less smoke. The above-mentioned conventional binders are, however, not useful for low smoke pyrotechnics.

Some other binder materials have therefore been proposed in the art. For instance, EP-A-1 982 968 describes a low smoke pyrotechnic composition wherein a fibrous nitrocellulose starting material is dissolved in a mixture of organic solvents. Fibrous nitrocellulose burns almost without smoke and can act as an oxidising agent and a fuel at the same time. It is therefore very suitable for low smoke pyrotechnics.

US-A-2002/0 148 540 disclose a low smoke pyrotechnic composition containing a nitrocellulose/nitroguanidine mixture combined with a polyvinyl alcohol binder material. Disadvantages of this composition include the presence of nitroguanidine and perchlorate. Nitroguanidine serves as a burn rate modifier and leads to unwanted lower burn rate and energy content of the formulations. Perchlorate serves as oxidiser and indeed may increase the burn rate and energy content, but will also result in an unwanted increase in smoke production of the base composition. Moreover, the preparation of the pyrotechnic compositions disclosed in this document relies on the undesirable use of volatile organic solvents.

The presence of volatile organic solvent, for instance for processing, is disadvantageous. Volatile organic solvents like acetone and ethanol are highly flammable. This can potentially result in dangerous situations when explosive vapour can build up. It is expensive to make installations and equipment compatible with the flammable solvent. In addition, the cost of these solvents is significant. Moreover, the solvents are environmentally unfriendly. Accordingly, there is a need in the art for providing a binder for pyrotechnic compositions that does not require the use of an organic solvent.

Objective of the invention is therefore to address one or more of these problems faced in the prior art. More in particular, the invention aims at providing a method for preparing a (low smoke) pyrotechnic composition comprising a water-soluble binder, which does not rely on the use of volatile organic solvents. Furthermore, the invention aims at providing a low smoke pyrotechnic composition that has sufficiently mechanical strength for the intended application, such as the preparation of pyrotechnic charge pellets. Also, the invention aims at providing a low smoke pyrotechnic composition comprising a low amount of binder material.

The invention is based on the insight of the inventors that a specific class of water-soluble binders is able to at least partly meet one or more of the above objectives.

Accordingly, in a first aspect, the invention is directed to a method for preparing a pyrotechnic composition comprising fibrous nitrocellulose and one or more water-soluble cellulose ether binders, the method comprising mixing the fibrous nitrocellulose in wet form with the one or more water-soluble cellulose ether binders and optionally one or more solvents, wherein the amount of organic solvent in the mixture is 10 wt. % or less based on total weight of the mixture.

The invention allows water to be used as a solvent for the cellulose ether binders. Hence, the amount of organic solvents can be considerably reduced or even avoided. This is highly advantageous, because water is non-flammable, cheap and environmentally friendly. Furthermore, the inventors found that using water-soluble cellulose ether binders in the preparation of pyrotechnic compositions allows the manufacture of pyrotechnic charges with a desired porosity. In addition, such charges (such as pellets) have surprisingly high mechanical strength, whilst yielding a relatively stable and clean combustion of the nitrocellulose based pyrotechnic charge. When applied in colour generating compositions (preferably low smoke colour generating compositions), there is only minor detrimental influence on the flame colour, and also the burn rate is hardly affected.

The amount of organic solvent in the mixture is preferably 5 wt. % or less based on total weight of the mixture, more preferably 2 wt. % or less, and most preferably no organic solvents are used in preparing the pyrotechnic composition of the invention. In an embodiment, the solvent(s) in the mixture consist(s) for 90 wt. % or more of water, preferably 95 wt. % or more, more preferably 98 wt. % or more. It is surprising that pyrotechnic composition thus formed can be suitably used for preparing charge having sufficient porosity.

The mixing can be performed using conventional methods and tools such as mixing equipment familiar to those skilled in the art of energetic material processing, such as for example horizontal mixers, kneading mixers, high shear mixers, and high speed mixers. Preferably, the components will be mixed at room temperature. Mixing can for instance be performed for 15-60 minutes, such as about 30 minutes.

The inventors aimed at formulating pyrotechnic compositions, for instance aimed at generating coloured flames, with smallest amounts of binder possible. At the same time the produced charges should be mechanically strong, and having good burn time (given a certain size of charge). The inventors found that the choice of binder has an important effect on the mechanical properties of the charges produced there from. Furthermore, it was found that the binder choice considerably influences the combustion of the pyrotechnic composition (purity of flame colour, burn time of a charge of given size, influence on colour, stability of combustion). Additionally, the charge density was found to have an effect on the ignitability of these pyrotechnic charges.

Authorities have determined that dry nitrocellulose with nitrogen mass percentage greater than 12.6 has to be considered as an explosive material and for transportation classification UN Class 1.1. Dry nitrocellulose is furthermore a hazardous material due to its sensitive nature (to spark, impact and friction).

In order to minimise the safety hazards during handling and transportation, the highly nitrated nitrocellulose is wetted with water such that the weight ratio between water and fibrous nitrocellulose in the pyrotechnic composition is at least 1:3. In this state, the mass is practically impossible to ignite and not considered to be an explosive material (UN Class 4.1). This has become a standard practice in industry, whenever this is possible.

Usually, the highly nitrated nitrocellulose is dried before it can be used in a subsequent processing step. The use of a water-soluble cellulose ether binder as provided by the invention renders drying of the bulk material directly after transport redundant. The water does not have to be removed, because it can be used as a solvent for the water-soluble cellulose ether binder. The nitrocellulose in wet condition is a very insensitive material. After transportation the insensitive nitrocellulose can be used in the same form without having to perform relatively dangerous pre-treatments (such as a drying step). Hence, the risks during any subsequent processing are significantly reduced. After processing (such as the preparation of pellets) the final product can be dried.

In addition, the water-soluble cellulose ether binder can be easily removed from tools used in manufacturing. It is advantageous that this binder can be removed by using normal water and soap. There is no need for organic solvents and the like which are harmful for the environment.

Preferably, the one or more water-soluble cellulose ether binders comprises one or more selected from the group consisting of hydroxyethyl cellulose, hydroxypropyl cellulose, hydroxypropylmethyl cellulose, hydroxybutylmethyl cellulose, methyl-2-hydroxyethyl cellulose, methyl-2-hydroxypropyl cellulose, 2-hydroxyethyl butyl cellulose, methyl cellulose, hydroxyethyl carboxymethyl cellulose, carboxymethyl cellulose, and 2-hydroxyethyl ethyl cellulose. In a particularly preferred embodiment, the one or more water-soluble cellulose ether binders comprise methyl-2-hydroxyethyl cellulose.

The water-soluble cellulose ether binder can be used in the composition in an amount of 0.1-15 wt. % based on total weight of the composition, preferably 0.5-10 wt. %, more preferably 1-5 wt. %, such as in an amount of about 2 wt. %. Binder contents of more than 15 wt. % may hinder good combustion of the composition. In this context the term "good combustion" is considered to include properties such as good burning time of pellets, complete combustion and thus minimal residue formation attributable to the binder, minimal explosive combustion due to confinement, etc. In addition, such high binder contents can be undesirably in the sense that the colour of combustion can be less appealing.

The fibrous nitrocellulose can be used in the composition in an amount of 20-99 wt. % based on total weight of the composition, such as 20-96 wt. %. In a preferred embodiment, the amount of fibrous nitrocellulose is in the range of 85-96 wt. %. Such high amounts of fibrous nitrocellulose are advantageous in providing a pyrotechnic composition that is substantially smokeless. Desirably, pyrotechnic compositions having this high amount of fibrous nitrocellulose exhibit relatively clean combustion. Fibrous nitrocellulose burns relatively cleanly. Depending on the degree of nitration, nitrocellulose can be represented by the chemical formulas $C_6H_9O_5(NO_2)$, $C_6H_8O_5(NO_2)_2$, or $C_6H_7O_5(NO_2)_3$. In accordance with the invention all of these formulas are referred to as nitrocellulose.

As additional components, the pyrotechnic composition of the invention may comprise one or more colourants and/or oxidising agents. Suitable examples of such compounds include ammonium nitrate, ammonium perchlorate, barium aminotetrazole, barium carbonate, barium chlorate, barium nitrate, calcium carbonate, basic copper carbonate, basic copper nitrate, copper acetoarsenite, copper arsenite, copper(I) chloride, copper(II) oxalate, copper oxychloride, copper powder, copper sulphate, potassium chlorate, potassium nitrate, potassium perchlorate, sodium aluminium fluoride, sodium bicarbonate, sodium carbonate, sodium chlorate, sodium chloride, sodium nitrate, sodium oxalate, strontium aminotetrazole, strontium carbonate, strontium nitrate, strontium oxalate and strontium peroxide. In a preferred embodiment, the one or more colourants and/or oxidising agents are selected from the group consisting of ammonium nitrate, barium aminotetrazole, barium carbonate, barium chlorate, barium nitrate, calcium carbonate, basic copper carbonate, basic copper nitrate, copper(I) chloride, copper(II) oxalate, copper oxychloride, copper powder, copper sulphate, potassium chlorate, potassium nitrate, sodium aluminium fluoride, sodium bicarbonate, sodium carbonate, sodium chlorate, sodium chloride, sodium nitrate, sodium oxalate, strontium aminotetrazole, strontium carbonate, strontium nitrate, strontium oxalate and strontium peroxide.

Several of these compounds have both a colouring function, as well as an oxidising function, whereas others only act as a colourant, or only as an oxidising agent. Naturally, also any combination of these colourants and/or oxidising agents may be applied.

The amount of colourants and/or oxidising agents taken together in the pyrotechnic composition of the invention can be 1-50 wt. % based on total weight of the composition, preferably 1-30 wt. %, more preferably 1-10 wt. %. Higher amounts of colourants and/or oxidising agents tend to increase smoke generation.

The pyrotechnic composition of the invention can further comprise one or more pyrotechnic fuels. Such fuels are known in the art. The amount of pyrotechnic fuels in the composition is preferably 20-96 wt. % based on the total weight of the composition.

The pyrotechnic composition can also comprise water, in particular during production processes. The amount of water used is preferably such that the weight ratio between water and fibrous nitrocellulose in the pyrotechnic composition is at least 1:3, more preferably in the range of 1:3-1:2. A pyrotechnic composition with a weight ratio between water and fibrous nitrocellulose of at least 1:3 is highly advantageous for transportation of highly nitrated nitrocellulose material, as explained above.

Furthermore, the pyrotechnic composition can comprise a chlorine donor, in particular when aimed at generating coloured flames. Suitable chlorine donors are known to the person skilled in the art and include organic chlorinated substances, such as polyvinylchloride (PVC) and the like.

In a further aspect, the invention is directed to a pyrotechnic composition obtainable by a method according to the invention. Such a pyrotechnic composition hence comprises fibrous nitrocellulose and one or more water-soluble cellulose ether binders as described herein.

In yet a further aspect, the invention is directed to the use of a water-soluble cellulose ether binder as strengthening agent in a fibrous nitrocellulose containing pyrotechnic composition. Preferably, the water-soluble cellulose ether binder is as defined herein. In a preferred embodiment, the invention includes the use of methyl-2-hydroxyethyl cellulose as strengthening agent in a fibrous nitrocellulose containing pyrotechnic composition.

In yet a further aspect, the invention is directed to a method for preparing a pyrotechnic charge, comprising forming the pyrotechnic composition of the invention into a pre-determined shape. Usually, the pyrotechnic charge is formed into a pellet shape.

In order to manufacture the pyrotechnic charge, the pyrotechnic composition may be compressed in a wet state. This wet state is meant to refer a state wherein the composition is in contact with water and optionally one or more further solvents. In a preferred embodiment, during compression the amount of organic solvent relative to the amount of total solvent is 10 wt. % or less, preferably 5 wt. % or less, more preferably 2 wt. % or less, and most preferably no organic solvents are used in preparing the charge of the invention. In an embodiment, the solvent(s) in the composition that is compressed consist(s) for 90 wt. % or more of water, preferably 95 wt. % or more, more preferably 98 wt. % or more. It is surprising that a pyrotechnic charge thus formed still has sufficient porosity. Water can be squeezed out of the charge if too much pressure is applied. The final density of the charge can be controlled by the percentage of water used in the composition, in combination with the applied pressure during compression.

Forming can comprise pressing, extruding, or the like. Pressing may be performed by a "star plate" as is generally known by the person skilled in the art (for manual production of batches), hydraulic or pneumatic presses (for relatively small production rates, down to individual items), or tablet presses (rotary tablet press or variants thereof, to allow greater production rates). Those skilled in the art will be able to adjust the production process to allow mixing and shaping of the pyrotechnic material by using extrusion equipment.

In yet a further aspect, the invention is directed to a pyrotechnic charge obtainable by the method of the invention, preferably in the form of a pellet. The inventors found that such charges have surprisingly high mechanical strength and do not easily disintegrate (such as fragment or fall apart). This is particularly surprising since organic solvents, which are normally used for inducing sufficient porosity, may be omitted in accordance with the present invention. Furthermore, the charges of the invention give a stable and clean combustion. Although in conventional pyrotechnic compositions components such as nitroguanidine are added in order to safeguard controlled combustion, charges prepared in accordance with the present invention do not require the presence such components. Hence, in an embodiment, the charge of the invention comprises 1 wt. % or less of nitroguanidine, preferably 0.5 wt. % or less, more preferably 0.2 wt. %, and even more preferably the charge of the invention is free of nitroguanidine. The charge can for instance be in the form of a pellet.

In an embodiment, the pyrotechnic charge of the invention has a density in the range of 0.15-1.2 g/cm$^3$, but most preferably the charge has a density of 0.15-0.45 g/cm$^3$. Charges having a density in these ranges are defined herein as "porous nitrocellulose charges". In another embodiment, when this composition is used to create pyrotechnic coloured charges, as given in Example 1, the density falls in a range of preferably 0.15-1.2 g/cm$^3$, more preferably 0.7-1.0 g/cm$^3$, and most preferably at least 0.8 g/cm$^3$.

The pyrotechnic compositions described in this invention can be applied in specific fireworks, such as for making pellets as "stars", pellets as "comets", and especially for those variants that are extremely low in smoke production.

In a specific embodiment, the composition of the invention can be employed to produce so-called porous nitrocellulose charges. Porous nitrocellulose charges can be used as a replacement for black powder (for example as a "lift charge" to propel fireworks comets and mines, or as the charges to propel certain types of munition like smoke grenades, or in ignition trains inside products employing energetic materials). Black powder consists of an intimate mixture of potassium nitrate, charcoal and sulphur, which is also highly compressed and granulated. Black powder has attractive characteristics for many applications in the field of pyrotechnics, because it burns relatively fast (even at ambient pressures), the substance is very stable and is easy to light. Furthermore, it lights other energetic materials very well, and black powder is made of materials which are relatively cheap.

Nevertheless, traditional black powder has several disadvantages. These include the production of significant amounts of smoke upon burning, inefficient burning (approximately half of the mass of black powder is not converted to useful gas), and limited availability (only a limited number of black powder variants are commercially available).

Many black powder substitutes have been proposed over time, but these fail to offer all the advantages which black powder poses. A porous nitrocellulose charge as described herein addresses as the above-mentioned problems, since it allows a reliable high burning rate at ambient pressures, it allows propelling devices smokeless with very high (gas yield) efficiency, and it allows to be shaped in specific geometries.

Furthermore, porous nitrocellulose charges based on compositions according to the present invention can be used as a replacement for conventional "burst charges" (in fireworks shells). Similar to the previously mentioned replacement for black powder, fireworks shells (aerial display shells) use pyrotechnic burst charges, comprising black powder, and/or other pyrotechnic mixtures using potassium perchlorate and potassium chlorate, using charcoal, and sulphur. In some instances in some caliber shells, instead of charcoal, it is common to use aluminium powder (yielding a "flash powder" type burst). Sometimes potassium or sodium salts of benzoate are also used as fuel ingredients in burst charges. It is quite common to see filler and carrier materials (such as rice hulls and cotton seed) used in combination with burst charges, in order to obtain certain "loading densities". The major disadvantage here again is the formation of smoke as an undesirable by-product, and the relative crude way in which a "loading density" is obtained. A porous nitrocellulose charge as described herein addresses these problems.

Further, porous nitrocellulose charges based on a composition according to the invention can be used as a gas generating agent. Such gas generating agents can for instance be applied in automotive inflatable devices, or in cartridges for power tools using propellants, actuators (such as cartridge actuated devices and propellant actuated devices), propulsion for underslung weapons (including non-lethal weapons) etc.

Pyrotechnic compositions according to the invention can further be used to produce military pyrotechnic flares, infrared decoy flares, and civilian pyrotechnics (road flares, railway fuses, SOLAS (Safety Of Life At Sea) distress type flares).

The invention will now be further illustrated by the following non-limitative Examples.

EXAMPLES

Example 1

A pyrotechnic colour composition in accordance with the invention was prepared by mixing the components in the Table below in the amounts as indicated (wt. % based on total composition weight).

| Component | wt. % |
|---|---|
| Fibrous nitrocellulose having a nitrogen content of 13.5 wt. % (based on nitrocellulose weight) | 85.00 |
| methyl-2-hydroxyethyl cellulose | 3.50 |
| $Ba(ClO_3)_2$ | 4.50 |
| $Ba(NO_3)_2$ | 4.50 |
| Polyvinylchloride | 2.50 |
| Total | 100.00 |

As a starting material, the wet fibrous nitrocellulose was used "as received". To this mixture, an amount of water was added so that the required weight ratio of water to nitrocellulose was created. This composition was mixed in a mixer for 30 minutes at room temperature.

While this composition is wet, the sensitivity to mechanical stimuli is very low (impact sensitivity is 50 Nm and friction sensitivity tests show no reaction at 360 N, determined with BAM equipment). After drying, these materials are sensitive again, but they fall in the same range of sensitivities of normal conventional pyrotechnic compositions.

This composition was loaded into a 38 mm press mould, and a pressure was applied so that pellets were obtained with a final density (after drying) of 0.8 g/cm$^3$. When such pellets were placed on the ground they gave a very pure deep green colour with hardly any smoke. When conventional pyrotechnic compositions were tested under equal conditions, a much paler, whitish colour was obtained with a lot of smoke.

These 38 mm pellets were launched from a tube, using conventional black powder charge. The pellet ignited nearly instantly, it did not produce any fragments, it produced a bright deep/pure green colour, and there was nearly no smoke. Again, here, when conventional pyrotechnic compositions were tested under equal conditions, a much paler, whitish colour was obtained with a lot of smoke.

Example 2

Porous charges were made by introducing the fibrous nitrocellulose into a high shear mixer and then mixing it in such a way that a paste-like consistency was obtained. The process started with a mixture of 55 g fibrous nitrocellulose and 55 g water. After 5 minutes of mixing the water-soluble binder was added and then mixing was continued for 5 minutes. At this point the remainder of the composition was added. After approximately half an hour a paste was obtained. Approximately 8 g of wet paste was placed in a special cylindrical shaped form, which had permeable walls allowing pressures to equilibrate. Directly after this step, the shaping form was transferred to a vacuum stove, and it was then subjected to vacuum condition (circa 0.2 atm) at 40° C. for 6 hours.

The invention claimed is:

1. A method for preparing a pyrotechnic composition comprising fibrous nitrocellulose and one or more water soluble cellulose ether binders, the method comprising:

mixing the fibrous nitrocellulose in wet form with the one or more water soluble cellulose ether binders and one or more solvents, wherein the one or more solvents comprise water and 2 wt. % or less of organic solvents and wherein the amount of said fibrous nitrocellulose in the composition is 20-96 wt. % based on total weight of the composition.

2. The method according to claim 1, wherein no organic solvents are used in preparing the pyrotechnic composition.

3. The method according to claim 1, wherein said one or more water soluble cellulose ether binders comprises one or more selected from the group consisting of hydroxyethyl cellulose, hydroxypropyl cellulose, hydroxypropylmethyl cellulose, hydroxybutylmethyl cellulose, methyl 2 hydroxyethyl cellulose, methyl 2 hydroxypropyl cellulose, 2 hydroxyethyl butyl cellulose, methyl cellulose, hydroxyethyl carboxymethyl cellulose, carboxymethyl cellulose, and 2 hydroxyethyl ethyl cellulose.

4. The method according to claim 1, wherein said one or more water soluble cellulose ether binders comprise methyl 2 hydroxyethyl cellulose.

5. The method according to claim 1, wherein the amount of said one or more water soluble cellulose ether binders in the composition is in the range of 0.1-15 wt. % based on total weight of the composition.

6. The method according to claim 1, wherein the amount of said fibrous nitrocellulose in the composition is 85-96 wt. % based on total weight of the composition.

7. The method according to claim 1, wherein said composition further comprises one or more colourants and/or oxidising agents, preferably selected from the group consisting of ammonium nitrate, ammonium perchlorate, barium aminotetrazole, barium carbonate, barium chlorate, barium nitrate, calcium carbonate, basic copper carbonate, copper acetoarsenite, copper arsenite, copper(I) chloride, copper(II) oxalate, copper oxychloride, copper powder, copper sulphate, potassium chlorate, potassium nitrate, potassium perchlorate, sodium aluminium fluoride, sodium bicarbonate, sodium carbonate, sodium chlorate, sodium chloride, sodium nitrate, sodium oxalate, strontium aminotetrazole, strontium carbonate, strontium nitrate, strontium oxalate and strontium peroxide.

8. The method according to claim 7, wherein said one or more colourants and/or oxidising agents in said composition sum up to an amount of 1-10 wt. %.

9. The method according to claim 1, wherein said composition further comprises one or more pyrotechnic fuels, preferably in an amount of 20-96 wt. % based on total weight of the composition.

10. The method according claim 1, wherein said composition further comprises water and wherein the weight ratio between water and fibrous nitrocellulose in said composition is in the range of 1:3-1:2.

11. The method according to claim 1, wherein the fibrous nitrocellulose has a nitrogen content of 12.6 wt. % or more.

12. A method for preparing a pyrotechnic composition, comprising:

mixing fibrous nitrocellulose in wet form with one or more water soluble cellulose ether binders and one or more solvents, wherein 2 wt. % or less organic solvents are included in the one or more solvents used in preparing the pyrotechnic composition, wherein the amount of said fibrous nitrocellulose in the pyrotechnic composition is 20-96 wt. % based on total weight of the pyrotechnic composition, and wherein the amount of said one or more water soluble cellulose ether binders in the pyrotechnic composition is 0.1-15 wt. % based on the total weight of the pyrotechnic composition.

13. The method according to claim 12, wherein said one or more water soluble cellulose ether binders comprises one or more selected from the group consisting of hydroxyethyl cellulose, hydroxypropyl cellulose, hydroxypropylmethyl cellulose, hydroxybutylmethyl cellulose, methyl 2 hydroxyethyl cellulose, methyl 2 hydroxypropyl cellulose, 2 hydroxyethyl butyl cellulose, methyl cellulose, hydroxyethyl carboxymethyl cellulose, carboxymethyl cellulose, and 2 hydroxyethyl ethyl cellulose.

14. The method according to claim 12, wherein said one or more water soluble cellulose ether binders comprises methyl 2 hydroxyethyl cellulose.

15. The method according to claim 12, wherein the amount of said fibrous nitrocellulose in the pyrotechnic composition is 85-96 wt. % based on total weight of the pyrotechnic composition.

16. The method according to claim 12, wherein said pyrotechnic composition further comprises one or more colourants and/or oxidising agents, preferably selected from the group consisting of ammonium nitrate, ammonium perchlorate, barium aminotetrazole, barium carbonate, barium chlorate, barium nitrate, calcium carbonate, basic copper carbonate, copper acetoarsenite, copper arsenite, copper(I) chloride, copper(II) oxalate, copper oxychloride, copper powder, copper sulphate, potassium chlorate, potassium nitrate, potassium perchlorate, sodium aluminium fluoride, sodium bicarbonate, sodium carbonate, sodium chlorate, sodium chloride, sodium nitrate, sodium oxalate, strontium aminotetrazole, strontium carbonate, strontium nitrate, strontium oxalate and strontium peroxide.

17. The method according to claim 16, wherein said one or more colourants and/or oxidising agents in said pyrotechnic composition sum up to an amount of 1-50 wt. % based on total weight of the pyrotechnic composition.

18. The method according to claim 12, wherein said composition further comprises one or more pyrotechnic fuels in an amount in the range of 20-96 wt. % based on total weight of the pyrotechnic composition.

19. A method for preparing a pyrotechnic composition, comprising:

mixing the fibrous nitrocellulose in wet form with the one or more water soluble cellulose ether binders, wherein less than about 2 wt. % organic solvents are used in preparing the pyrotechnic composition, wherein the amount of said fibrous nitrocellulose in the composition is 85-96 wt. % based on total weight of the pyrotechnic composition, and wherein said composition further comprises a pyrotechnic fuel in an amount in the range of 20-96 wt. % based on the total weight of the pyrotechnic composition.

20. The method of claim 1, wherein the amount of said one or more water soluble cellulose ether binders in the composition is in the range of 0.5-10 wt. %.

21. The method of claim 1, wherein the amount of said one or more water soluble cellulose ether binders in the composition is in the range of 1 to 5 wt. %.

* * * * *